US010116043B2

(12) United States Patent
Liou et al.

(10) Patent No.: US 10,116,043 B2
(45) Date of Patent: Oct. 30, 2018

(54) ANTENNA MODULE AND WEARABLE DEVICE USING SAME

(71) Applicant: Chiun Mai Communication Systems, Inc., New Taipei (TW)

(72) Inventors: Geng-Hong Liou, New Taipei (TW); Chien-Chang Liu, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 123 days.

(21) Appl. No.: 15/199,791

(22) Filed: Jun. 30, 2016

(65) Prior Publication Data

US 2017/0141459 A1 May 18, 2017

(30) Foreign Application Priority Data

Nov. 13, 2015 (CN) ..... 2015 1 0774563

(51) Int. Cl.

| | |
|---|---|
| ***H01Q 1/48*** | (2006.01) |
| ***H01Q 1/27*** | (2006.01) |
| ***H01Q 1/50*** | (2006.01) |

(52) U.S. Cl.
CPC ..... *H01Q 1/273* (2013.01); *H01Q 1/48* (2013.01); *H01Q 1/50* (2013.01)

(58) Field of Classification Search
CPC ..... H01Q 1/48; H01Q 1/50; H01Q 1/273
USPC ..... 343/718
See application file for complete search history.

(56) References Cited

U.S. PATENT DOCUMENTS

2011/0012796 A1* 1/2011 Kim ..... H01Q 1/273 343/702

* cited by examiner

*Primary Examiner* — Andrea Lindgren Baltzell
(74) *Attorney, Agent, or Firm* — ScienBiziP, P.C.

(57) ABSTRACT

An antenna module includes a main body, a baseboard, and a ground portion. The main body is made of conductive material. The baseboard is received in the main body and includes a feed point. One end of the feed point is electrically connected to the main body. Another end of the feed point feeds current to the main body. The ground portion is grounded and defines a space. The baseboard is spaced from the main body to form a first gap therebetween. The ground portion is positioned in the first gap to electrically connect the baseboard to the main body and an area of the first gap corresponding to the space forms a second gap.

20 Claims, 9 Drawing Sheets

ANTENNA MODULE AND WEARABLE DEVICE USING SAME

CROSS-REFERENCE TO RELATED APPLICATIONS

This application claims priority to Chinese Patent Application No. 201510774563.0 filed on Nov. 13, 2015, the contents of which are incorporated by reference herein.

FIELD

The subject matter herein generally relates to an antenna module and a wearable device using same.

BACKGROUND

Wearable devices, such as smart watches, bracelets, generally have a wireless communication function and include an antenna for establishing a wireless communication connection with other electronic devices, such as mobile phones, or personal digital assistants, for example. Additionally, many wearable devices further employ metal housings for improving heat dissipation or other purposes.

BRIEF DESCRIPTION OF THE DRAWINGS

Implementations of the present technology will now be described, by way of example only, with reference to the attached figures.

DETAILED DESCRIPTION

Figure 1:
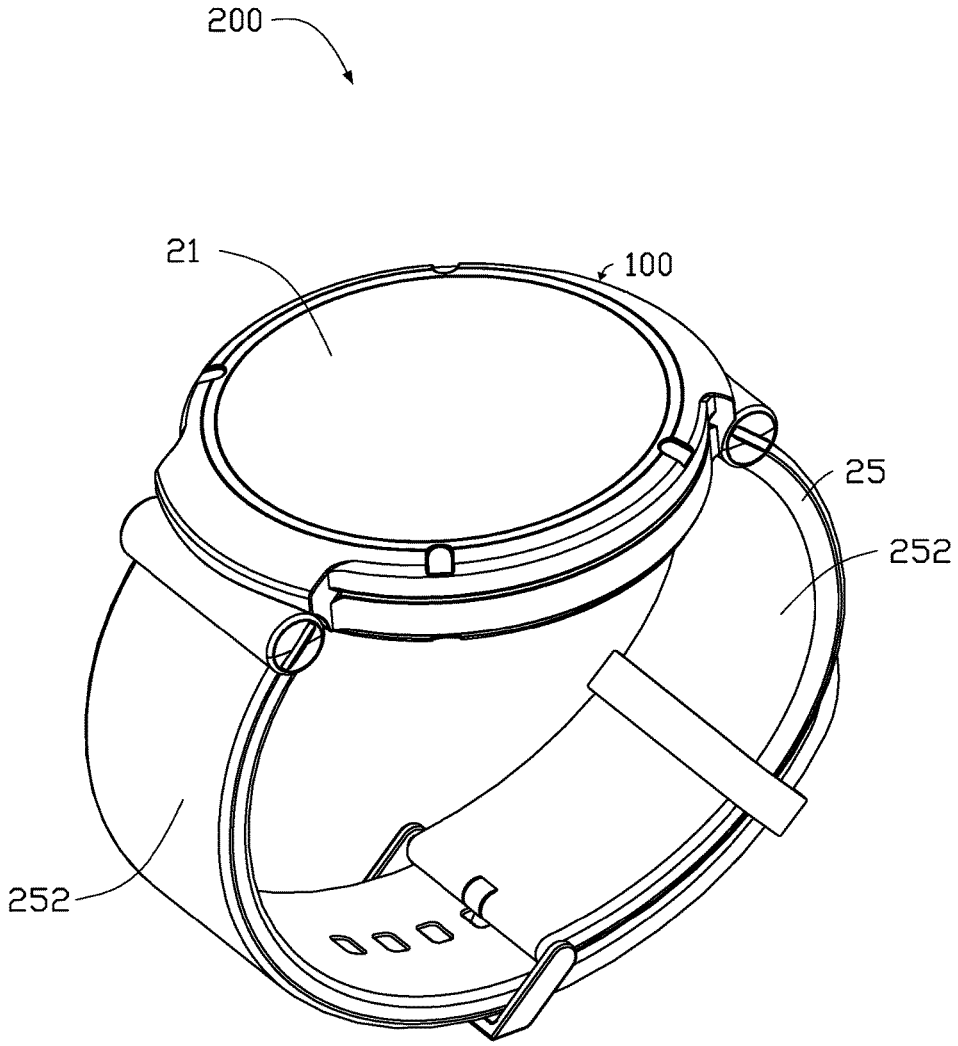
FIG. 1 is an elevational view of an embodiment of a wearable device employing an antenna module.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna module and a wearable device using same.

FIG. 1 illustrates an embodiment of an antenna module 100, which can be applied to a wearable device 200, for example, a smart watch. The antenna module 100 is configured to receive/send wireless signals. In at least one embodiment, the antenna module 100 is applied to a smart watch. In other embodiments, the antenna module 100 can also be applied to other wearable devices 200, for example, a wireless earphone.

Figure 2:
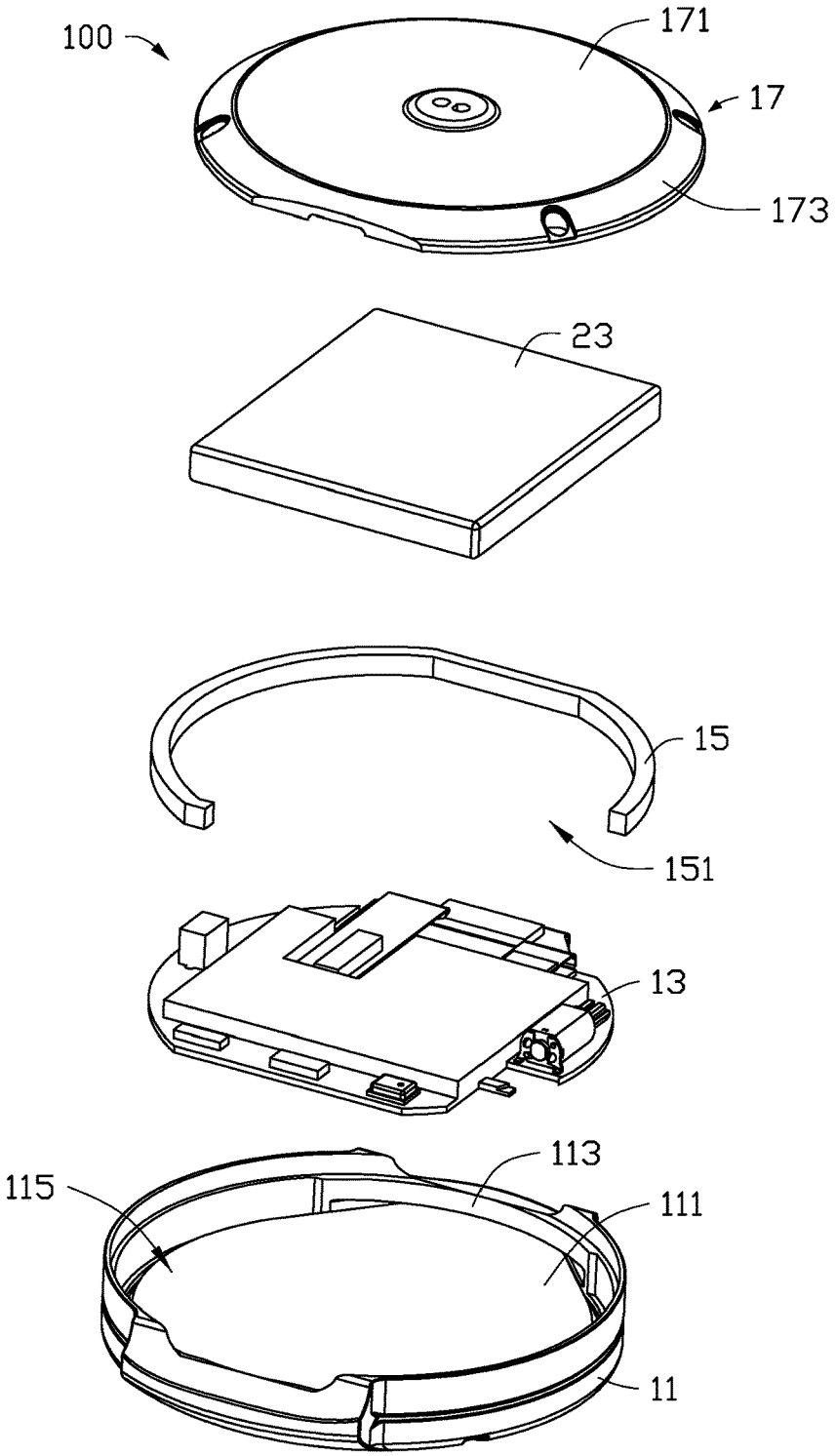
FIG. 2 is an exploded, isometric view of the antenna module of FIG. 1.

FIG. 2 illustrates that the antenna module 100 includes a main body 11, a baseboard 13, a ground portion 15, and a housing 17.

In at least one embodiment, the main body 11 is substantially circular. The main body 11 is made of conductive material, for example, metallic material. It can be understood that the main body 11 can also have other shapes, for example, square or oval. The main body 11 includes a bottom planar wall 111 and a peripheral wall 113. The peripheral wall 113 is positioned at a periphery of the bottom planar wall 111. The peripheral wall 113 and the bottom planar wall 111 cooperatively form a dish-shaped receiving space 115.

Figure 3:
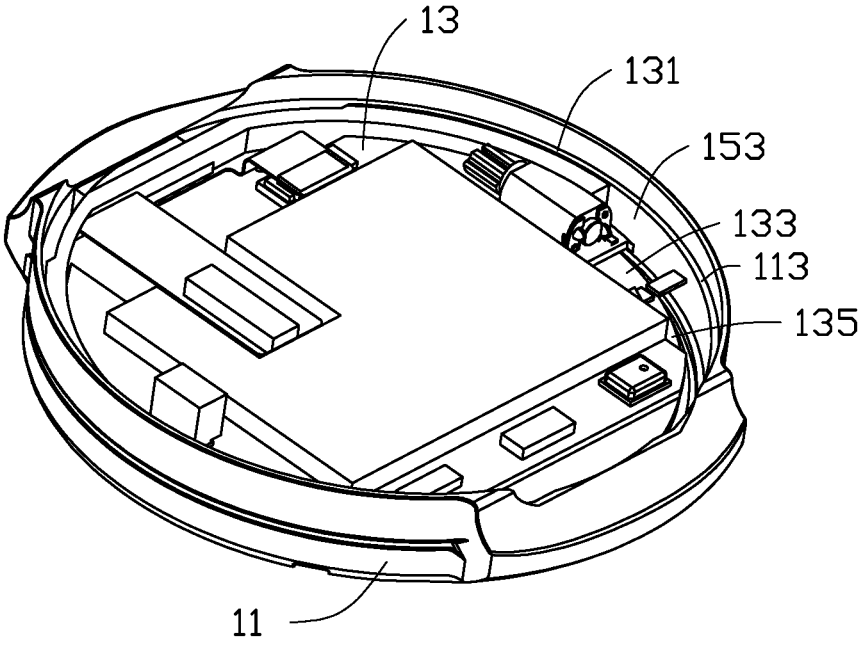
FIG. 3 is a partially assembled, isometric view of antenna module of FIG. 2.

FIG. 3 illustrates that the baseboard 13 is a printed circuit board (PCB). The baseboard 13 is positioned in the receiving space 115 and is spaced from the main body 11. Then, a periphery of the baseboard 13 is spaced from the peripheral wall 113 of the main body 11, thereby forming a first gap 131 therebetween. In at least one embodiment, the first gap 131 is substantially an annular loop.

In at least one embodiment, the baseboard 13 includes a feed point 133. The feed point 133 is electrically connected to the main body 11 through a connecting portion, for example, a terminal or the like. The feed point 133 is further electrically connected to a signal source (not shown) for feeding current to the antenna module 100.

In at least one embodiment, the ground portion 15 is substantially an arcuate frame. The ground portion 15 is made of conductive material and is grounded. The free ends of the ground portion 15 define a space 151 therebetween. The ground portion 15 is positioned in the first gap 131 and is configured to connect the main body 11 to the baseboard 13. Additionally, due to the ground portion 15 defining the space 151, when the ground portion 15 is positioned in the first gap 131, an area of the first gap 131 corresponding to the space 151 is empty, thereby forming a second gap 153. The second gap 153 is substantially arcuate. Then, the antenna module 100 can activate a working frequency band through the second gap 153. In at least one embodiment, the antenna module 100 can work at Bluetooth (BT) frequency band. In other embodiments, the antenna module 100 can work at other frequency bands.

The housing 17 is a portion of the wearable device 200 contacting with a user. The housing 17 has a shape and a structure corresponding to the main body 11. For example, the housing 17 can be circular or square. The housing 17 is assembled to the main body 11 through a latching structure, for example, screw. The housing 17 seals the receiving space 115 and receives the baseboard 13 and the ground portion 15 together with the main body 11.

In at least one embodiment, the housing 17 includes a first housing 171 and a second housing 173 surrounding the first housing 171. In at least one embodiment, the first housing 171 is made of conductive material (for example, metallic material) or insulating material (for example, palastic or ceramic). The second housing 173 is made of insulating material. Generally, when an antenna is used, the user is at a radiating area of the antenna, then, different portions of the user, for example, the head or the hands of the user will affect a radiating performance of the antenana. Then, when the first housing 171 is made of conductive material and the wearable device 200 is attached to the wrist of the uer, the first housing 171 mading of conductive material will shield an influence of the user on the antenna module 100, that is, an ininfluence of the user on the antenna module 100 can be decreased, and thereby a radiating performance of the antenna module 100 can be improved.

It can be understood that, in at least one embodiment, to obtain a better radiating performance, a width of the second housing 173 is larger than 1.5 mm. Additionally, the housing 17 can be electrically connected to the baseboard 13 (that is, the housing 17 is grounded), or the housing 17 is spaced and disconnected from the baseboard 13.

It can be understood that the baseboard 13 further includes a keep-out-zone 135. The purpose of the keep-out-zone 135 is to delineate an area on the baseboard 13 in which other electronic elements (such as a camera, a vibrator, a speaker, etc.) cannot be placed. A shape of the keep-out-zone 135 and a position of the keep-out-zone 135 on the baseboard 13 can be adjusted according to a need of the user. In at least one embodiment, the keep-out-zone 135 is positioned adjacent to the second gap 153.

As illustrated in FIGS. 1 and 2, when the antenna module 100 is applied to the wearable device 200, the main body 11 serves as a watch cover of the wearable device 200. The housing 17 serves as a back cover of the wearable device 200. The wearable device 200 further includes a display unit 21, a battery 23, and a watchband 25.

The display unit 21 can be a liquid crystal module (LCM) or the like. The display unit 21 is positioned at one surface of the main body 11 opposite to the housing 17. The display unit 21 is electrically connected to the baseboard 13. The battery 23 is received in the receiving space 115. The battery 23 is positioned between the baseboard 13 and the housing 17. The battery 23 is configured to supply power to the wearable device 200.

The watchband 25 is configured to attach the wearable device 200 to a user. In at least one embodiment, the watchband 25 includes two watchband portions 252. Each watchband portion 252 is made of insulating material, for example, leather. One end of the two watchband portions 252 are connected to each other. The other ends of the two watchband portions 252 are respectively assembled to two sides of the main body 11 through a latching structure (not shown), thereby the wearable device 200 can be firmly attached to a wrist of the user.

Figure 4:
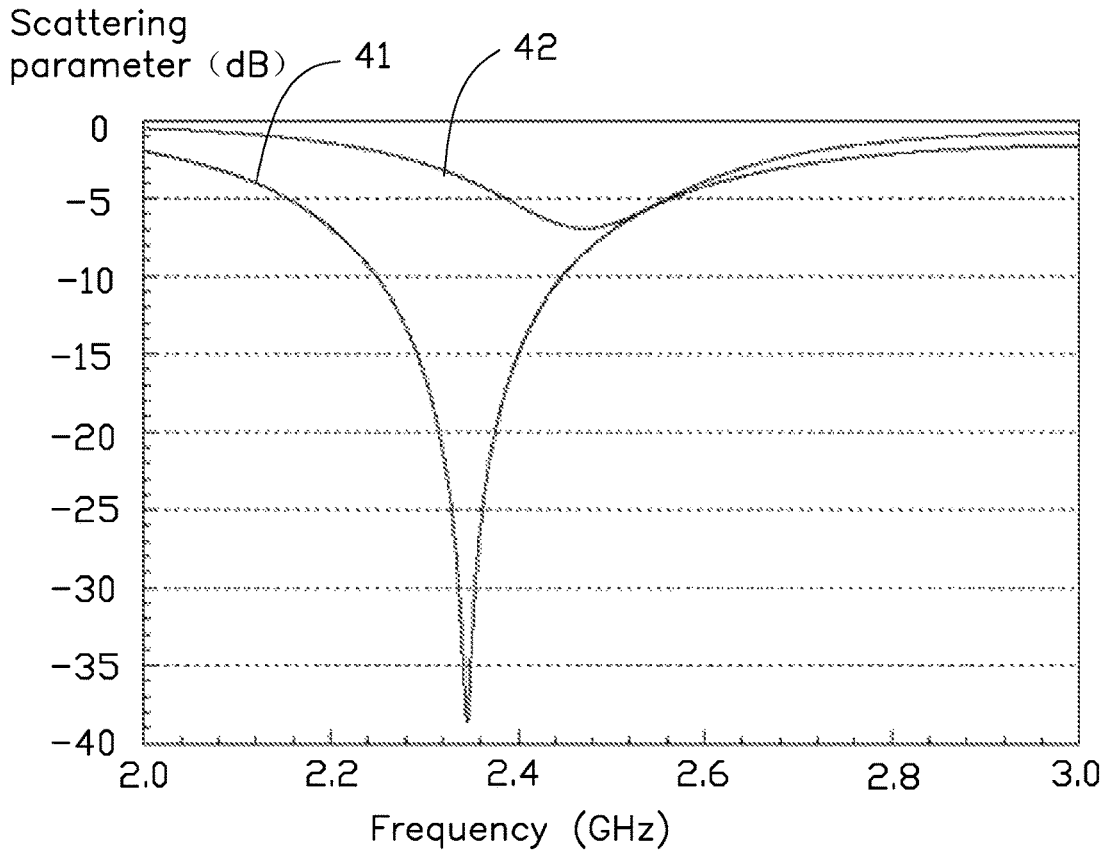
FIG. 4 is a scattering parameter graph of the antenna module of FIG. 2, when a first housing and a second housing of the antenna module are both made of insulating material.

FIG. 4 illustrates a scattering parameter graph of the antenna module 100, when the first housing 171 and the second housing 173 are both made of insulating material. In detail, curve 41 illustrates a scattering parameter when the wearable device 200 is attached to the wrist of the uer. Curve 42 illustrates a scattering parameter when the wearable device 200 is not attached to the wrist of the uer.

Figure 5:
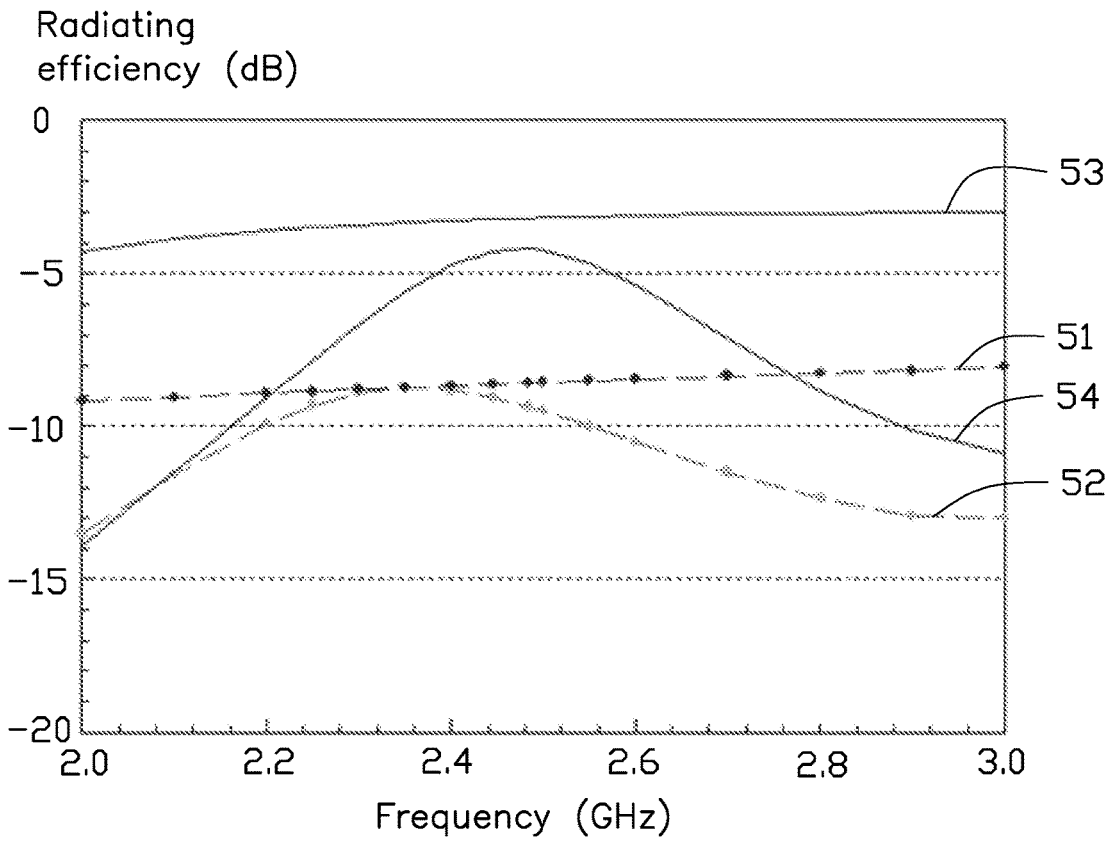
FIG. 5 is a radiating efficiency graph of the antenna module of FIG. 2, when a first housing and a second housing of the antenna module are both made of insulating material.

FIG. 5 illustrates a radiating efficiency graph of the antenna module 100, when the first housing 171 and the second housing 173 are both made of insulating material. In detail, curve 51 illustrates a radiating efficiency when the wearable device 200 is attached to the wrist of the uer. Curve 52 illustrates a total radiating efficiency when the wearable device 200 is attached to the wrist of the uer. Curve 53 illustrates a radiating efficiency when the wearable device 200 is not attached to the wrist of the uer. Curve 54 illustrates a total radiating efficiency when the wearable device 200 is not attached to the wrist of the uer.

Figure 6:
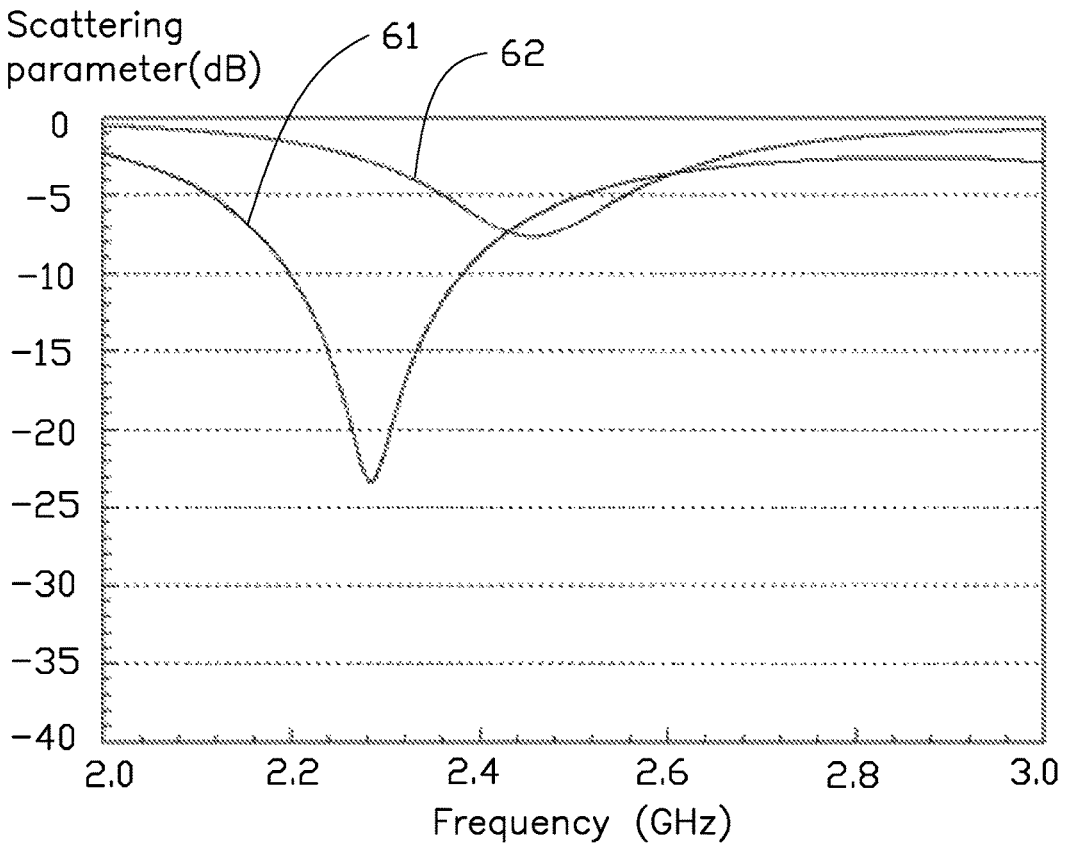
FIG. 6 is a scattering parameter graph of the antenna module of FIG. 2, when a first housing is made of conductive material, a second housing of the antenna module is made of insulating material, and a housing is not electrically connected to a baseboard.

FIG. 6 illustrates a scattering parameter graph of the antenna module 100, when the first housing 171 is made of conductive material, the second housing 173 is made of insulating material, and the first housing 171 is not electrically connected to the baseboard 13. In detail, curve 61 illustrates a scattering parameter when the wearable device 200 is attached to the wrist of the uer. Curve 62 illustrates a scattering parameter when the wearable device 200 is not attached to the wrist of the uer.

Figure 7:
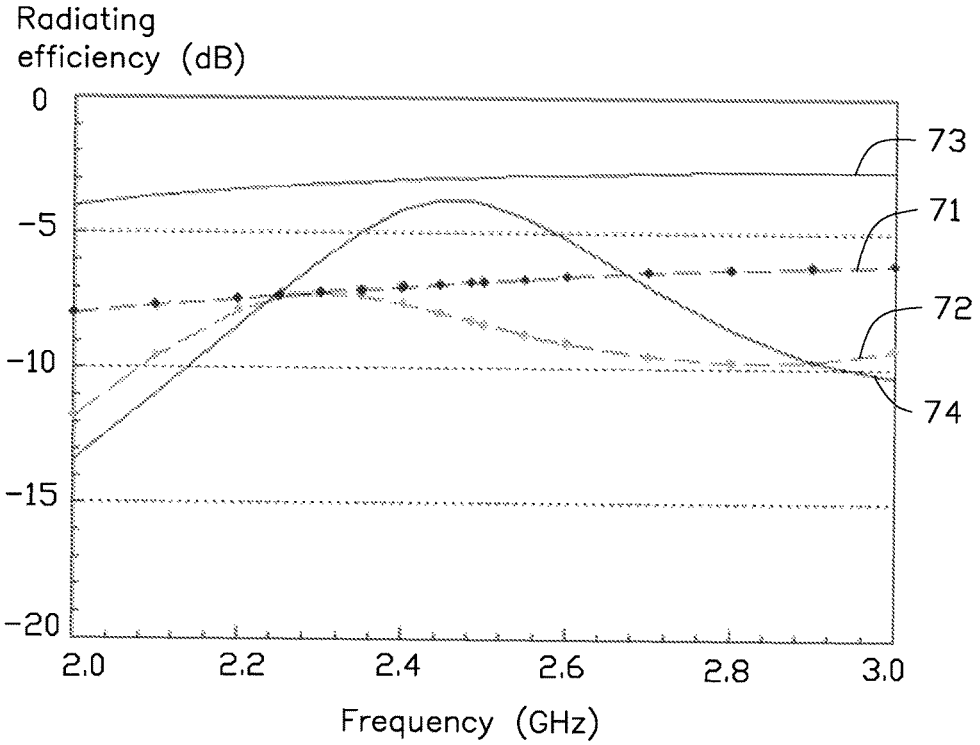
FIG. 7 is a radiating efficiency graph of the antenna module of FIG. 2, when a first housing is made of conductive material, a second housing of the antenna module is made of insulating material, and a housing is not electrically connected to a baseboard.

FIG. 7 illustrates a radiating efficiency graph of the antenna module 100, when the first housing 171 is made of conductive material, the second housing 173 is made of insulating material, and the first housing 171 is not electrically connected to the baseboard 13. In detail, curve 71 illustrates a radiating efficiency when the wearable device 200 is attached to the wrist of the uer. Curve 72 illustrates a total radiating efficiency when the wearable device 200 is attached to the wrist of the uer. Curve 73 illustrates a radiating efficiency when the wearable device 200 is not attached to the wrist of the uer. Curve 74 illustrates a total radiating efficiency when the wearable device 200 is not attached to the wrist of the uer.

Figure 8:
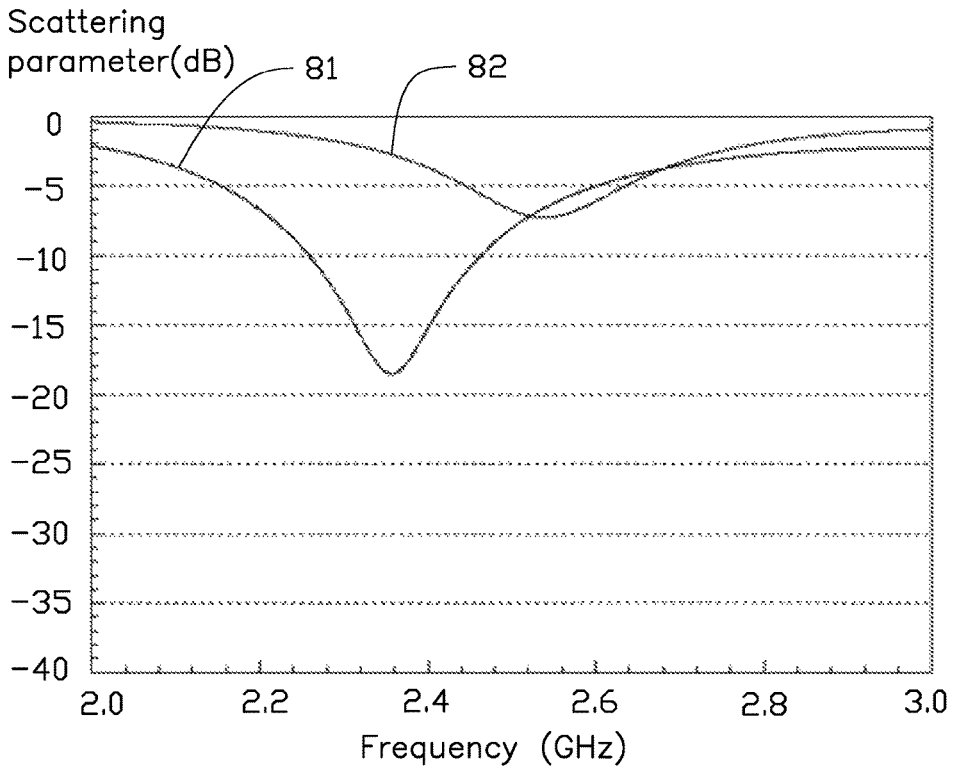
FIG. 8 is a scattering parameter graph of the antenna module of FIG. 2, when a first housing is made of conductive material, a second housing of the antenna module is made of insulating material, and a housing is electrically connected to a baseboard.

FIG. 8 illustrates a scattering parameter graph of the antenna module 100, when the first housing 171 is made of conductive material, the second housing 173 is made of insulating material, and the first housing 171 is electrically connected to the baseboard 13. In detail, curve 81 illustrates a scattering parameter when the wearable device 200 is attached to the wrist of the uer. Curve 82 illustrates a scattering parameter when the wearable device 200 is not attached to the wrist of the uer.

Figure 9:
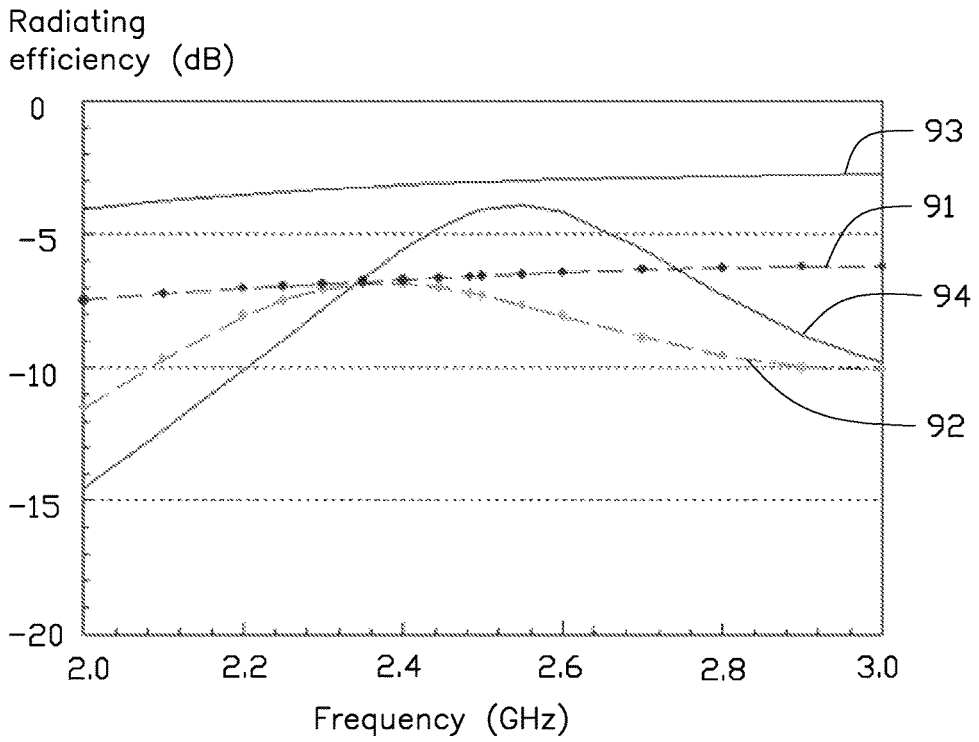
FIG. 9 is a radiating efficiency graph of the antenna module of FIG. 2, when a first housing is made of conductive material, a second housing of the antenna module is made of insulating material, and a housing is electrically connected to a baseboard.

FIG. 9 illustrates a radiating efficiency graph of the antenna module 100, when the first housing 171 is made of conductive material, the second housing 173 is made of insulating material, and the first housing 171 is electrically connected to the baseboard 13. In detail, curve 91 illustrates a radiating efficiency when the wearable device 200 is attached to the wrist of the uer. Curve 92 illustrates a total radiating efficiency when the wearable device 200 is attached to the wrist of the uer. Curve 93 illustrates a radiating efficiency when the wearable device 200 is not attached to the wrist of the uer. Curve 94 illustrates a total radiating efficiency when the wearable device 200 is not attached to the wrist of the uer.

In view of FIGS. 4 to 9 and table 1, the antenna module 100 includes the first houding 171 mading of conductive material, which can effectively decrease an influence of the user on the wearable device 200 and does not affect a free space performance of the antenna module 100.

TABLE 1 a radiating efficiency of the antenna module at different conditions

| A radiating efficiency when the antenna module works at 2.4 GHz | The wearable device is not attached to the wrist of the user | The wearable device is attached to the wrist of the user |
|---|---|---|
| The first and second housings are both made of insulating material | −4.7 dB | −8.8 dB |
| The first housing is made of conductive material, the second housing is made of insulating material, and the first housing is not electrically connected to the baseboard | −4.3 dB | −7.6 dB |
| The first housing is made of conductive material, the second housing is made of insulating material, and the first housing is electrically connected to the baseboard | −4.7 dB | −6.8 dB |

The embodiments shown and described above are only examples. Many details are often found in the art such as the other features of the antenna module and the wearable device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna module comprising:

a main body made of conductive material and being a watch cover of a wearable device;

a baseboard received in the main body and comprising a feed point, one end of the feed point electrically connected to the main body, another end of the feed point electrically connected to a signal source for feeding current to the main body;

a ground portion being grounded and defining a space;

wherein the baseboard is spaced from the main body to form a first gap therebetween, the ground portion is positioned in and partially fills the first gap, wherein the ground portion is configured to electrically connect the baseboard to the main body, and an area of the first gap corresponding to the space forms a second gap.

2. The antenna module of claim 1, wherein the baseboard further comprises a keep-out-zone, the keep-out-zone is positioned adjacent to the second gap.

3. The antenna module of claim 1, further comprising a housing, wherein the housing is assembled to the main body and is configured to receive the baseboard together with the main body.

4. The antenna module of claim 3, wherein the housing comprises a first housing and a second housing surrounding the first housing, the first housing is made of conductive material, and the second housing is made of insulating material.

5. The antenna module of claim 4, wherein the first housing is not electrically connected to the baseboard.

6. The antenna module of claim 4, wherein the first housing is electrically connected to the baseboard.

7. The antenna module of claim 4, wherein a width of the second housing is larger than 1.5 mm.

8. The antenna module of claim 3, wherein the housing comprises a first housing and a second housing surrounding the first housing, the first housing and the second housing are both made of insulating material.

9. The antenna module of claim 3, wherein the housing serves as a back cover of the wearable device.

10. A wearable device comprising:

a display unit;

a watchband; and an antenna module comprising:

a main body made of conductive material and being a watch cover of the wearable device;

a baseboard received in the main body and comprising a feed point, one end of the feed point electrically connected to the main body, another end of the feed point electrically connected to a signal source for feeding current to the main body;

a ground portion being grounded and defining a space;

wherein the display unit is positioned on the main body and is electrically connected to the baseboard, the watchband is assembled to two sides of the main body, the baseboard is spaced from the main body to form a first gap therebetween, the ground portion is positioned in and partially fills the first gap, wherein the ground portion is configured to electrically connect the baseboard to the main body, and an area of the first gap corresponding to the space forms a second gap.

11. The wearable device of claim 10, wherein the baseboard further comprises a keep-out-zone, the keep-out-zone is positioned adjacent to the second gap.

12. The wearable device of claim 10, further comprising a housing, wherein the housing is assembled to the main body and is configured to receive the baseboard together with the main body.

13. The wearable device of claim 12, wherein the housing comprises a first housing and a second housing surrounding the first housing, the first housing is made of conductive material, and the second housing is made of insulating material.

14. The wearable device of claim 13, wherein the first housing is not electrically connected to the baseboard.

15. The wearable device of claim 13, wherein the first housing is electrically connected to the baseboard.

16. The wearable device of claim 13, wherein a width of the second housing is larger than 1.5 mm.

17. The wearable device of claim 12, wherein the housing comprises a first housing and a second housing surrounding the first housing, the first housing and the second housing are both made of insulating material.

18. The wearable device of claim 12, wherein the housing is a back cover of the wearable device.

19. A wearable device comprising:

a watch cover made of conductive material and forming a receiving space;

a back cover sealing the receiving space;

a baseboard received in the receiving space and comprising a feed point, one end of the feed point electrically connected to the watch cover, another end of the feed point electrically connected to a signal source for feeding current to the watch cover;

a display positioned on the watch cover and electrically connected to the baseboard;

a ground portion being grounded and defining a space;

wherein the baseboard is spaced from the watch cover to form a first gap therebetween, the ground portion is positioned in and partially fills the first gap, wherein the ground portion is configured to electrically connect the baseboard to the watch cover, and an area of the first gap corresponding to the space forms a second gap.

20. The wearable device of claim 19, further comprising a watchband, wherein the watchband is assembled to two sides of the watch cover.

* * * * *